US010196244B2

(12) United States Patent
Harauchi et al.

(10) Patent No.: US 10,196,244 B2
(45) Date of Patent: Feb. 5, 2019

(54) JIB CONNECTION STRUCTURE

(71) Applicant: TADANO LTD., Kagawa (JP)

(72) Inventors: Yuji Harauchi, Kagawa (JP); Yuki Hata, Kagawa (JP)

(73) Assignee: TADANO LTD., Kagawa (JP)

( * ) Notice: Subject to any disclaimer, the term of this patent is extended or adjusted under 35 U.S.C. 154(b) by 12 days.

(21) Appl. No.: 15/516,705

(22) PCT Filed: Oct. 27, 2015

(86) PCT No.: PCT/JP2015/005381
§ 371 (c)(1),
(2) Date: Apr. 4, 2017

(87) PCT Pub. No.: WO2016/151648
PCT Pub. Date: Sep. 29, 2016

(65) Prior Publication Data

US 2017/0305726 A1 Oct. 26, 2017

(30) Foreign Application Priority Data

Mar. 20, 2015 (JP) ..... 2015-058202

(51) Int. Cl.
*B66C 23/70* (2006.01)
*B66C 23/66* (2006.01)

(52) U.S. Cl.
CPC ..... *B66C 23/70* (2013.01); *B66C 23/66* (2013.01); *B66C 23/702* (2013.01)

(58) Field of Classification Search
CPC ..... B66C 23/62; B66C 23/64; B66C 23/66; B66C 23/68; B66C 23/70; B66C 23/701; B66C 23/702
See application file for complete search history.

(56) References Cited

U.S. PATENT DOCUMENTS 4,106,631 A * 8/1978 Lundy ..... B66C 23/702 212/177
4,141,455 A * 2/1979 Henderson ..... B66C 23/702 212/300

(Continued)

FOREIGN PATENT DOCUMENTS

JP 02-127693 10/1990
JP 08-127494 5/1996

(Continued)

OTHER PUBLICATIONS

Jan. 19, 2016, International Search Report issued for related WO application No. PCT/JP2015/005381.

*Primary Examiner* — Michael R Mansen
*Assistant Examiner* — Juan J Campos, Jr.
(74) *Attorney, Agent, or Firm* — Paratus Law Group, PLLC

(57) ABSTRACT

Provided is a jib connection structure capable of connecting a jib base end engagement part and a jib connection shaft even when a boom undergoes natural extension, and capable of restraining a jib from swinging sideways in a state where the jib is projected. This jib connection structure includes: jib connection shafts projecting horizontally toward both sides from a boom tip end part; and jib base end engagement parts respectively provided to bifurcated jib base end parts. Each jib base end engagement part is U-shaped into which the jib connection shaft can be fitted, and is provided with an insertion hole into which a pin for preventing the jib connection shaft from slipping out is inserted. When the jib base end engagement part and jib connection shaft are connected, a gap is formed between the pin and jib connection shaft. When a jib is projected, the gap becomes smaller.

3 Claims, 9 Drawing Sheets

(56) References Cited

U.S. PATENT DOCUMENTS

| | | | | |
|---|---|---|---|---|
| 4,155,464 | A * | 5/1979 | Hogg | B66C 23/702 212/300 |
| 7,337,912 | B1 * | 3/2008 | Hull | B66C 23/42 212/168 |
| 2011/0147331 | A1 * | 6/2011 | Tanaka | B66C 23/42 212/299 |
| 2018/0037446 | A1 * | 2/2018 | Harauchi | B66C 23/702 |

FOREIGN PATENT DOCUMENTS

| | | |
|---|---|---|
| JP | 11-011878 | 1/1999 |
| JP | 2006-264956 | 10/2006 |
| JP | 2011-131975 | 7/2011 |

* cited by examiner

JIB CONNECTION STRUCTURE

CROSS REFERENCE TO PRIOR APPLICATION

This application is a National Stage Patent Application of PCT International Patent Application No. PCT/JP2015/005381 (filed on Oct. 27, 2015) under 35 U.S.C. § 371, which claims priority to Japanese Patent Application No. 2015-058202 (filed on Mar. 20, 2015), which are all hereby incorporated by reference in their entirety.

TECHNICAL FIELD

The present invention relates to jib connection structures, and more specifically, to a connection structure between a boom leading end and a jib base end.

BACKGROUND ART

Patent Literature (hereinafter, referred to as "PTL") 1 discloses a jib connection structure composed of a jib connection shaft projecting in both lateral directions of a boom leading end and jib base end engagement portions provided at a bifurcated jib base end. The jib base end engagement portions are U-shaped and can be engaged with the jib connection shaft. The jib base end engagement portions can be connected to the jib connection shaft by engaging the jib base end engagement portions with the jib connection shaft and inserting pins into through holes in leading ends of the jib base end engagement portions.

For a jib projection operation, a boom is firstly slightly extended, the jib is then moved to a lower holding position of the boom, and the boom is fully retracted. The jib connection shaft is thereby fitted into the jib base end engagement portions. Subsequently, pins are inserted into through holes in the jib base end engagement portions to connect the jib base end engagement portions to the jib connection shaft. Subsequently, the boom is elevated up, so that the jib is suspended from the boom leading end. Lastly, the jib is projected, by exerting tension on a tension rod.

In the meantime, a wire telescoping mechanism is known as a telescoping mechanism of a boom (see, for example, PTL 2). When the wire telescoping mechanism is adopted, simultaneous extension or retraction of a multi-section boom is possible by means of telescopic motion of one hydraulic cylinder. In the wire telescoping mechanism, when for some reasons the balance of the tension between each wire for extension and retraction of the boom is disturbed, the so-called natural extension may sometimes occur in which the boom is not fully retracted despite that the hydraulic cylinder is fully retracted, or in which the boom unexpectedly extends after having been retracted. When the boom naturally extends, there is a problem that a pin interferes with a jib connection shaft and cannot be inserted, so that jib base end engagement portions cannot be connected to the jib connection shaft.

Against this problem, it may be considered to allow clearance between the pin and the jib connection shaft in anticipation of natural extension of the boom. However, an operation in a state where a jib is projected may sometimes cause force acting in a lateral direction on the jib. In this case, there is a problem that the jib swings sideways when the clearance between the pin and the jib connection shaft is too large.

CITATION LIST

Patent Literature

PTL 1: Japanese Patent Application Laid-Open No. 2006-264956

PTL 2: Japanese Patent Application Laid-Open No. 8-127494

SUMMARY OF THE INVENTION

Problems to Be Solved by the Invention it is therefore an object of the present invention to provide a jib connection structure capable of connecting jib base end engagement portions to a jib connection shaft even when a boom naturally extends, and restraining a jib from swinging sideways in a state where the jib is projected.

Solutions to Problems

A jib connection structure of a first aspect of the present invention is a connection structure between a leading end of a boom and a base end of a jib, the connection structure including a jib connection shaft horizontally projecting in both lateral directions of the leading end of the boom; and jib base end engagement portions provided at respective ends of the bifurcated base end of the jib, in which: the jib base end engagement portions are U-shaped into which the jib connection shaft is allowed to be fitted, and include insertion holes for insertion of pins, the pins being intended for preventing slipping off of the jib connection shaft; the insertion holes in one of the jib base end engagement portions is placed laterally outwardly from a U-shaped bottom portion; and the laterally outwardly placed insertion holes are located at a position at which a gap is formed between the inserted pin and the jib connection shaft in a state where the jib connection shaft is fitted into the jib base end engagement portions and a leading end of the jib is placed laterally from the boom, and at which the gap between the inserted pin and the jib connection shaft becomes narrower in a state where the jib is projected.

A jib connection structure of a second aspect pf the present invention is a connection structure between a leading end of a boom and a base end of a jib, the connection structure including a jib connection shaft horizontally projecting in both lateral directions of the leading end of the boom; and jib base end engagement portions provided at respective ends of the bifurcated base end of the jib, in which: the jib base end engagement portions are U-shaped into which the jib connection shaft is allowed to be fitted, and include insertion holes for insertion of pins, the pins being intended for preventing slipping off of the jib connection shaft; and the insertion holes in one of the jib base end engagement portions are placed laterally outwardly from a U-shaped bottom portion, and a distance between said insertion holes and said bottom portion in a direction along a central axis of the jib is substantially the same as an outer diameter of the jib connection shaft.

Effects of the Invention

According to the first and/or the second aspect(s) of the invention, when the jib base end engagement portions are connected to the jib connection shaft, the gap is formed between the pin and the jib connection shaft; therefore, even when the boom naturally extends, the jib base end engagement portions can be connected to the jib connection shaft. Further, when the jib is projected, the gap between the pin and the jib connection shaft becomes narrower. Therefore, the jib can be restrained from swinging sideways.

DESCRIPTION OF EMBODIMENTS

In the following, an embodiment of the present invention will be described with reference to the drawings.

Figure 1:
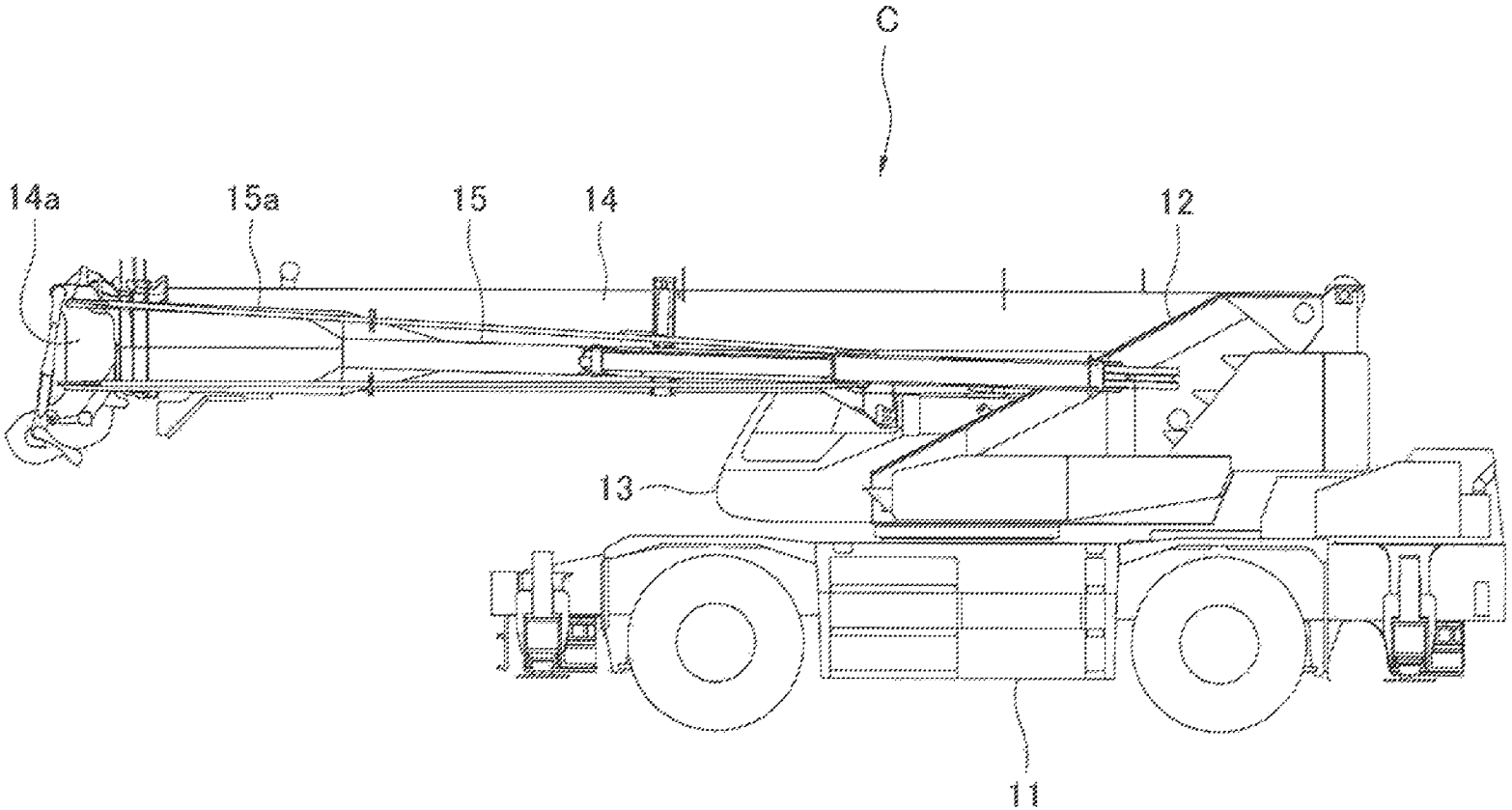
FIG. 1 is a side view illustrating mobile crane C in which jib 15 is in a stowed condition.

A jib connection structure according to one embodiment of the invention is applied, for example, to mobile crane C as illustrated in FIG. 1. In the meantime, the jib connection structure according to the embodiment can be applied, but not limited, to mobile crane C as illustrated in FIG. 1 and can be applied to different cranes.

(Mobile Crane)

To begin with, the basic structure of mobile crane C will be described.

Reference numeral 11 in FIG. 1 indicates a traveling chassis provided with wheels for traveling. Slewing base 12 is mounted on chassis 11 in such a manner as to be able to slew 360 degrees in the horizontal plane by a slewing motor. Slewing base 12 is provided with operator's cab 13.

Boom 14 is attached to slewing base 12 such that boom 14 can be freely elevated and lowered. A base end of boom 14 is pivotally supported by a pin on slewing base 12. A boom elevating cylinder is attached between boom 14 and slewing base 12. Boom 14 is elevated when the boom elevating cylinder is extended, and lowered when the boom elevating cylinder is retracted.

Boom 14 is a multi-section boom configured to be telescopic, and extends and retracts by a telescopic cylinder. A telescoping mechanism of boom 14 is a wire telescoping mechanism. The wire telescoping mechanism is a mechanism which is composed of a telescopic cylinder and wires for extension and retraction of a boom, and is configured to transmit telescopic motion of the telescopic cylinder to each tubular section of boom 14 by means of the wires for extension and retraction of the boom. The telescopic motion of the hydraulic cylinder allows simultaneous extension or retraction of the multi-section boom. In the wire telescoping mechanism, when for some reasons the balance of the tension between each wire for extension and retraction of the boom is disturbed, the so-called natural extension may sometimes occur in which the boom is not fully retracted despite that the hydraulic cylinder is fully retracted, or in which the boom unexpectedly extends after having been retracted.

A wire rope provided with a hook (not illustrated) is suspended from leading end 14*a* of boom 14, and is guided along boom 14 to slewing base 12 and wound around a winch. The winch is driven to rotate forward and reverse by a hoist motor, to wind up and pay out the wire rope, thereby allowing the hook to be moved up and down.

Combination of slewing of slewing base 12; elevating, lowering, extending, and retracting of boom 14; and moving up and down of the hook allows loading and unloading in a three-dimensional space.

Further, mobile crane C is provided with jib 15. Jib 15 as a whole is an elongated bar member, base end 15*a* of which is bifurcated. Jib 15 is employed for achieving a lifting height and/or operating radius still greater than a lifting height and/or operating radius of the boom length of fully extended boom 14. When jib 15 is not used, jib 15 is stowed along a side of boom 14 (see FIG. 1). When jib 15 is used, base end 15*a* of jib 15 is connected to leading end 14*a* of boom 14, and jib 15 is projected forward from boom 14 (see FIG. 9).

(Jib Connection Structure)

In the following, the jib connection structure of the embodiment will be described.

The jib connection structure of the embodiment is a structure for connecting leading end 14*a* of boom 14 (hereinafter referred to as "boom leading end 14*a* ") to base end 15*a* of jib 15 (hereinafter referred to as "jib base end 15*a* ") in mobile crane C as described above.

Figure 2:
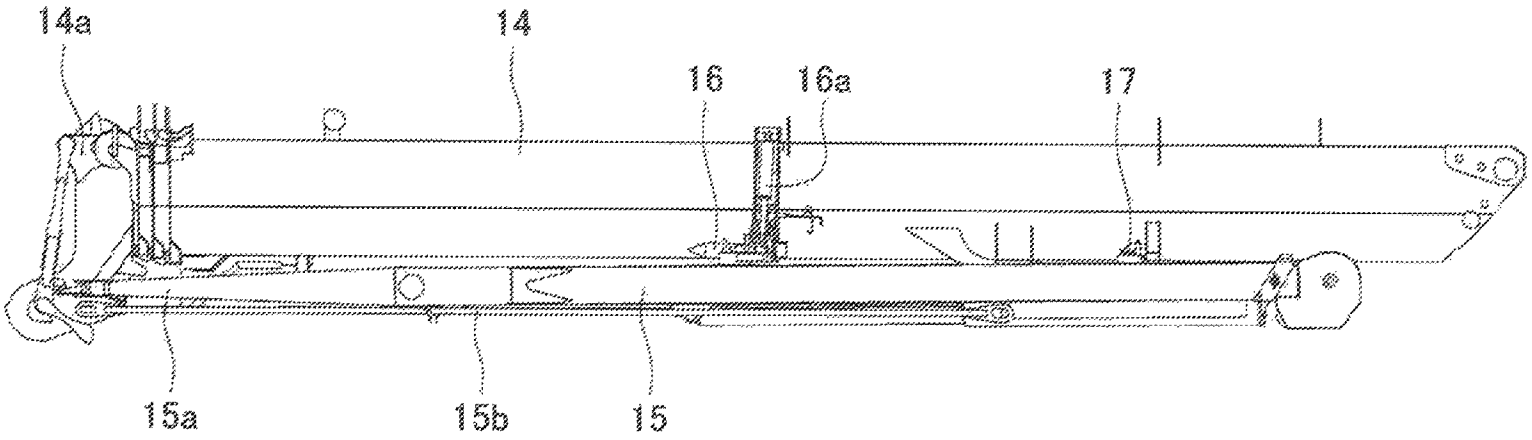
FIG. 2 is a side view of jib 15 and boom 14, in which jib 15 is placed in a lower holding position of boom 14.
Figure 3:
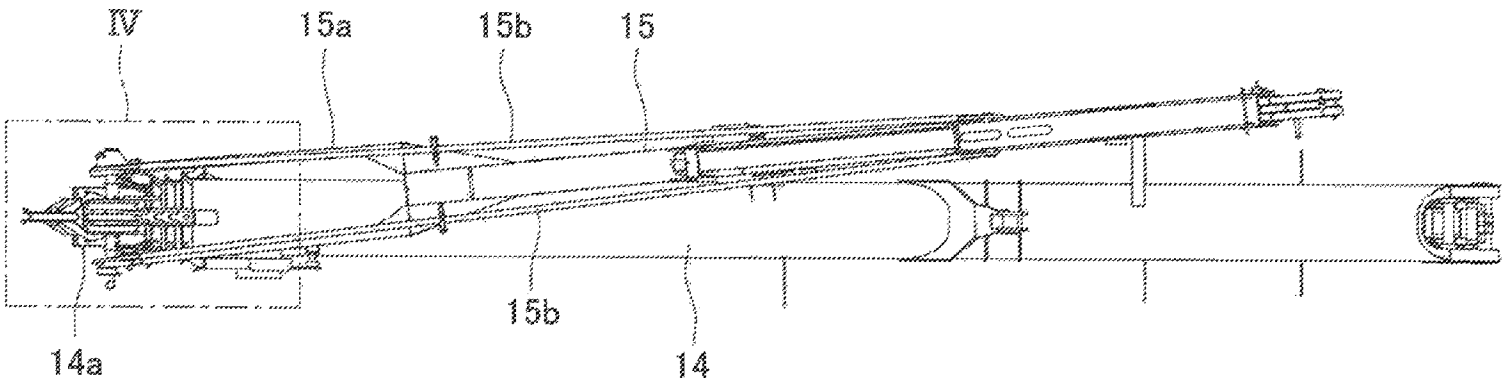
FIG. 3 is a bottom view of jib 15 and boom 14, in which jib 15 is placed in the lower holding position of boom 14.

FIGS. 2 and 3 are side and bottom views illustrating a state where jib 15 is placed in a lower holding position in which jib 15 is placed along the bottom side of boom 14. As will be described below, in a jib projection/stowage operation, boom leading end 14*a* is connected to/disconnected from jib base end 15*a* in the state where jib 15 is placed in the lower holding position.

As illustrated in FIG. 3, in the state where jib 15 is placed in the lower holding position, jib 15 is in an offset placement in which jib base end 15*a* is located at boom leading end 14*a*, and a leading end of jib 15 is located laterally from boom 14. In this respect, the leading end of jib 15 is located on the opposite side of operator's cab 13 with respect to boom 14. Hereinafter, in the offset placement, the side on which the leading end of jib 15 is located is referred to as the left side, and the opposite side thereto (the side of operator's cab 13) is referred to as the right side. However, an embodiment in which the right and left sides are reversed is possible.

Figure 4:
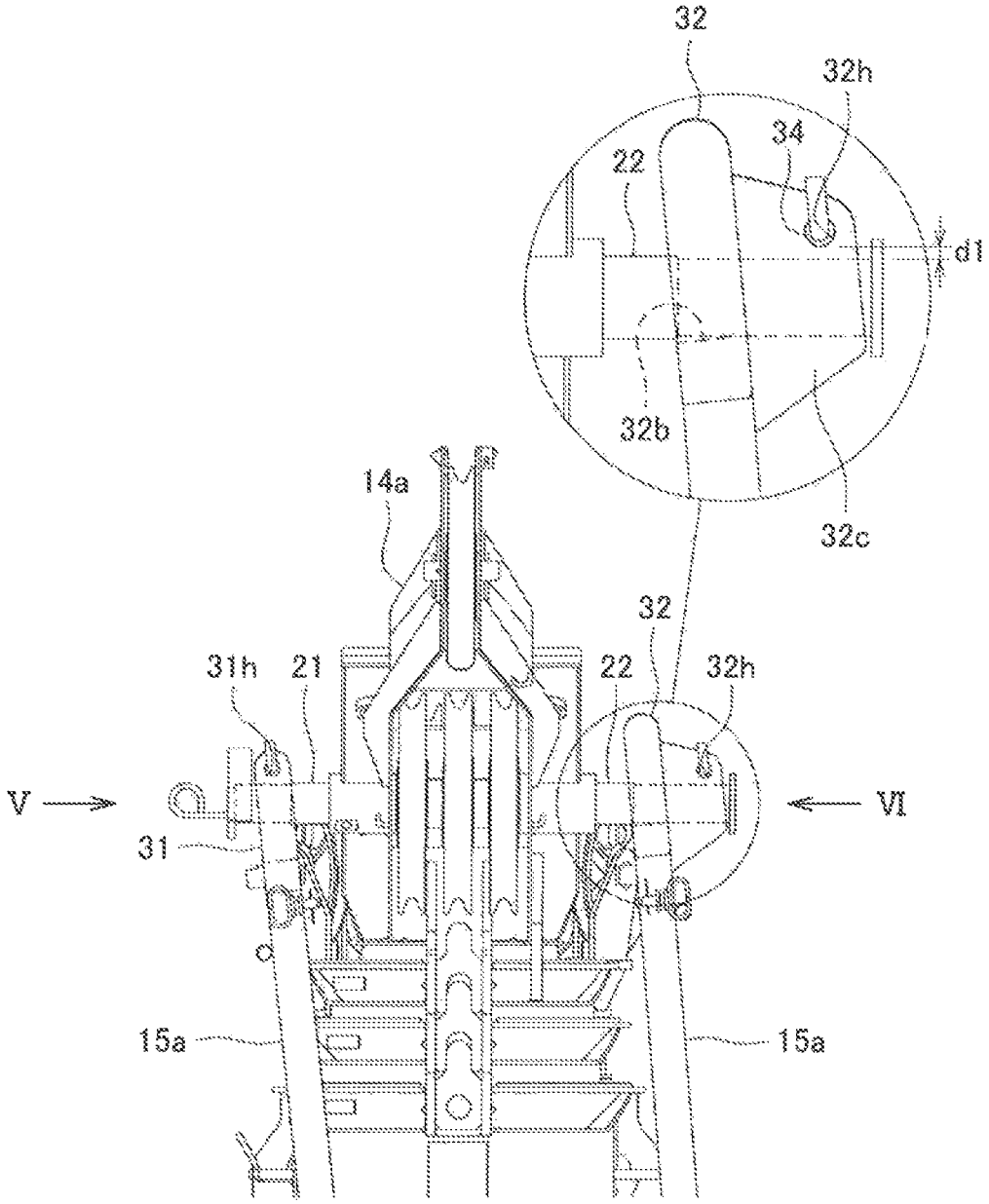
FIG. 4 is an enlarged view of region IV in FIG. 3.

As illustrated in FIG. 4, boom leading end 14*a* is provided with jib connection shafts 21, 22 horizontally projecting in both lateral directions of boom leading end 14*a*. Right and left jib connection shafts 21, 22 are coaxially placed. Further, respective ends of bifurcated jib base end 15*a* are provided with jib base end engagement portions 31, 32.

Figure 5:
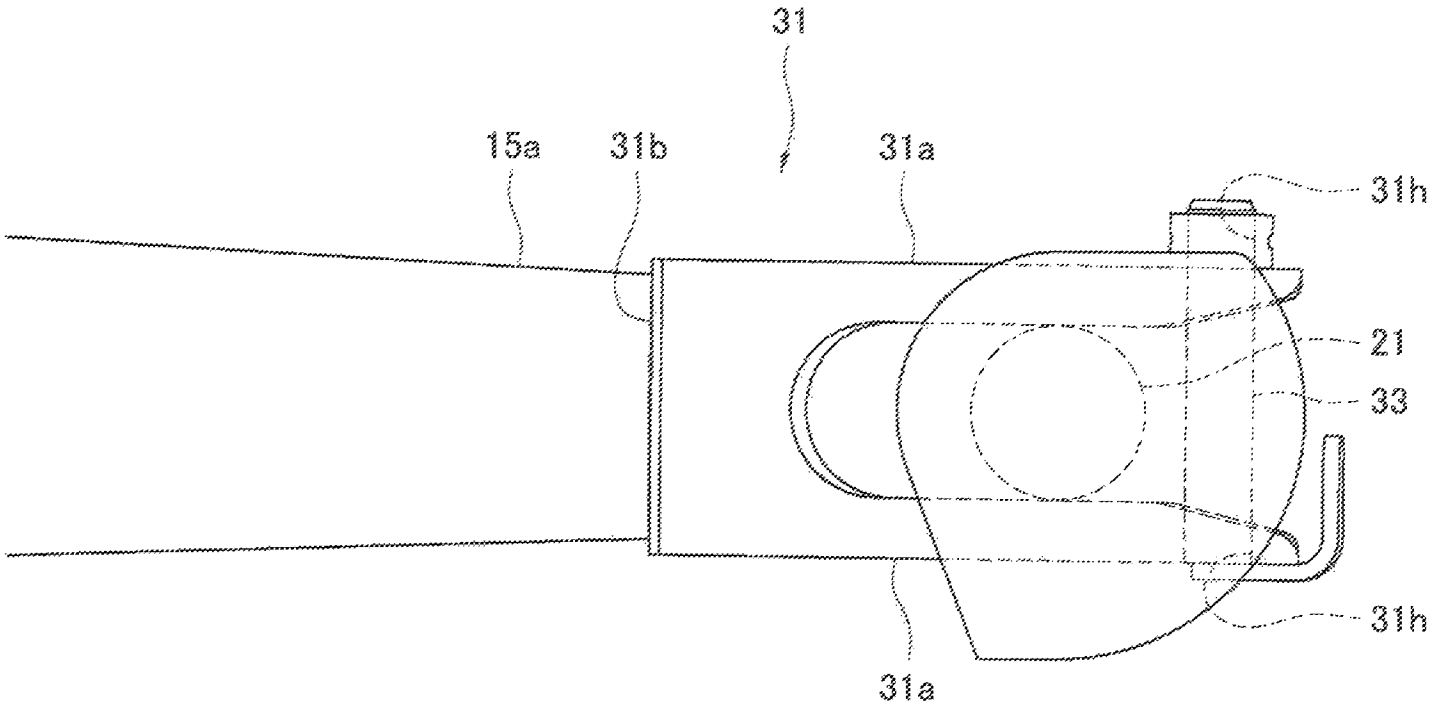
FIG. 5 is an enlarged view as seen in the direction of arrow V in FIG. 4.

As illustrated in FIG. 5, right jib base end engagement portion 31 is formed to have a U-shape composed of a pair of arms 31*a* and bottom portion 31*b* connecting base parts of the arms. The U-shape of jib base end engagement portion 31 has an inner diameter slightly, greater than an outer diameter of right jib connection shaft 21. As a result, jib connection shaft 21 can be fitted between the pair of arms 31*a*. In the meantime, bottom portion 31*b* is a portion in which the inner surface of bottom portion 31*b*, in a state where jib 15 is projected, makes contact with jib connection shaft 21 so as to transmit force acting on jib 15 to jib connection shaft 21.

Insertion holes 31*h* are formed in leading ends of the pair of arms 31*a*. Jib connection shaft 21 is prevented from slipping off by fitting jib connection shaft 21 into jib base end engagement portion 31 and inserting pin 33 into insertion holes 31*h*. Jib base end engagement portion 31 can thus be connected to jib connection shaft 21.

Figure 6:
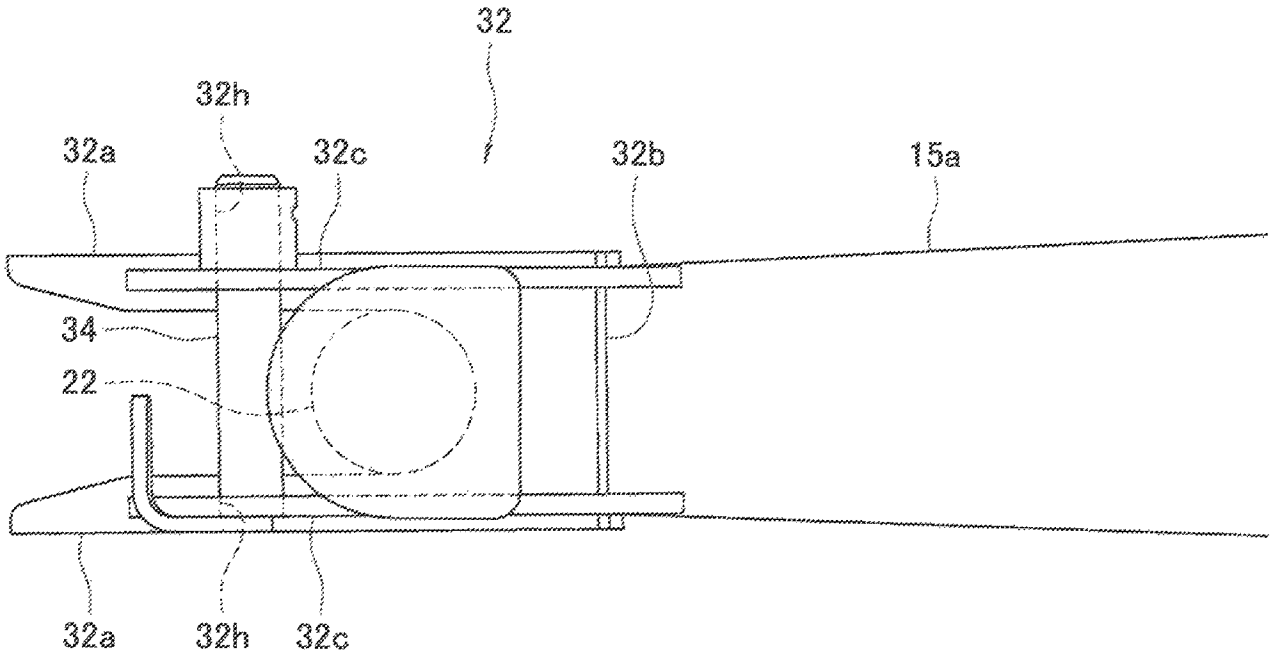
FIG. 6 is an enlarged view as seen in the direction of arrow VI in FIG. 4.

As illustrated in FIG. 6, left jib base end engagement portion 32 is formed to have a U-shape composed of a pair of arms 32*a* and bottom portion 32*b* connecting base parts of the arms. The U-shape of jib base. end engagement portion 32 has an inner diameter slightly greater than an outer diameter of left jib connection shaft 22. Jib connection shaft 22 can thus be fitted between the pair of arms 32*a*. In the meantime, bottom portion 32*b* is a portion in which the inner surface of bottom portion 32*b*, in a state where jib 15 is projected, makes contact with jib connection shaft 22 so as to transmit farce acting on jib 15 to jib connection shaft 22.

Sides of arms 32*a* are each provided with extension plates 32*c*, with extension plates 32*c* projecting outwardly. These extension plates 32*c* are provided with insertion holes 32*h*. Jib connection shaft 22 is prevented from slipping off by fitting jib connection shaft 22 into jib base end engagement portion 32 and inserting pin 34 into insertion holes 32*h*. Jib base end engagement portion 32 can thus be connected to jib connection shaft 22.

As illustrated in FIG. 4, left jib base end engagement portion 32 is provided with extension plates 32*c*, and extension plates 32*c* are provided with insertion holes 32*h*. Insertion holes 32*h* are thus placed laterally outwardly from bottom portion 32*b* on which a load is applied in a state where jib 15 is projected. In a state where jib connection shafts 21, 22 are fitted into jib base end engagement portions 31, 32 and the leading end of jib 15 is placed laterally from boom 14, gap d1 is formed between pin 34 inserted into insertion holes 32*h* and jib connection shaft 22.

In the meantime, jib 15 is supported by a base end boom and jib connection shafts 21, 22 are fixed to a leading end boom. Accordingly, when boom 14 naturally extends, the position of jib 15 remains unchanged and jib connection shafts 21, 22 move in the direction of the boom leading end. As a result, jib connection shaft 22 moves toward pin 34. Normally, when boom 14 naturally extends in a case where there is no gap between pin 34 and jib connection shaft 22, pin 34 interferes with jib connection shaft 22 and cannot be inserted into insertion holes 32*h*. Jib base end engagement portion 32 thus cannot be connected to jib connection shaft 22.

In contrast, in the embodiment, when jib base end engagement portion 32 is connected to jib connection shaft 22, gap d1 is formed between pin 34 and jib connection shaft 22. Accordingly, when it is within the range of gap d1 that boom 14 naturally extends, pin 34 can be inserted into insertion holes 32*h* without interfering with jib connection shaft 22 and jib base end engagement portion 32 can be connected to jib connection shaft 22.

Figure 7:
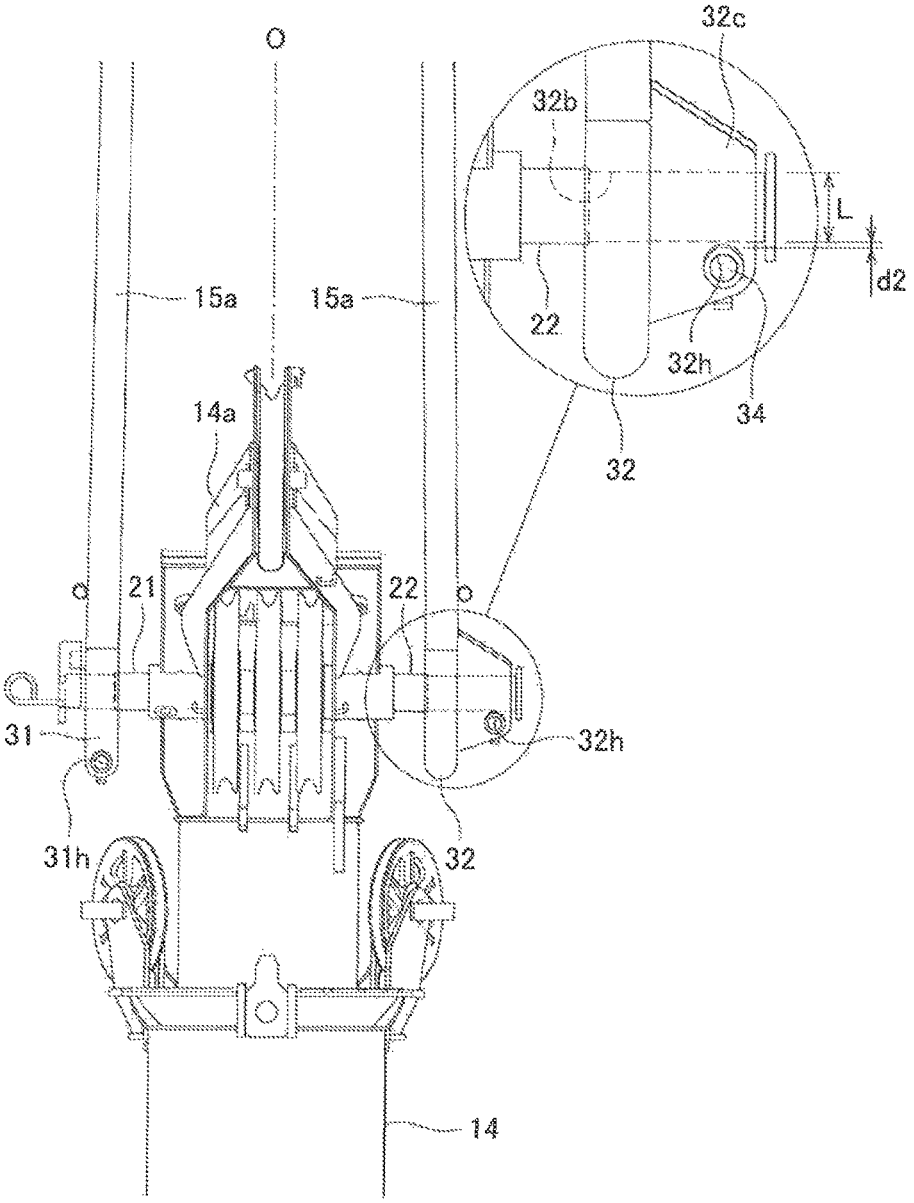
FIG. 7 is a bottom view of jib 15 and boom 14, in which jib 15 is projected.

FIG. 7 is a bottom view illustrating a state where jib 15 is projected. When jib 15 is projected, jib 15 that has been in the offset placement rotationally moves in a lateral direction to be in substantially straight alignment with boom 14. That is, central axis O of jib 15 becomes parallel to a central axis of boom 14 and vertical with respect to jib connection shafts 21, 22

As illustrated in FIG. 7, in left jib base end engagement portion 32, distance L between insertion holes 32*h* and bottom portion 32*b* in a direction along central axis O of jib 15 is substantially the same as the outer diameter of jib connection shaft 22. The phrase "substantially the same" here means not only that distance L is the same as the outer diameter of jib connection shaft 22, but also that distance L is slightly greater than the outer diameter of jib connection shaft 22.

In a state where jib 15 is projected, gap d2 between pin 34 inserted into insertion holes 32*h* and jib connection shaft 22 becomes narrower than in the case of the offset placement (d1). This is because, when jib 15 is projected, jib 15 that has been in the offset placement rotationally moves in the counterclockwise direction in FIG. 7, so that pin 34 approaches jib connection shaft 22.

An operation in a state where jib 15 is projected, for example slewing with a load being suspended causes force acting on jib 15 in a lateral direction. In this case, when clearances between pins 33, 34 and jib connection shafts 21, 22 are too large, jib 15 swings sideways.

In contrast, in the embodiment, insertion holes 32*h* are placed in the position as described above; therefore, pin 34 is in contact with jib connection shaft 22 or there is a small clearance between pin 34 and jib connection shaft 22. That is, jib connection shaft 22 is brought into a state where jib connection shaft 22 is held between bottom portion 32*b* of jib base end engagement portion 32 and pin 34 and is supported from the front and rear. As a result, rotational movement of jib 15 in the counterclockwise direction in FIG. 7 is restrained.

As described above, when jib 15 is projected, the gap between pin 34 and jib connection shaft 22 becomes narrower; therefore, the jib can be restrained from swinging sideways. In the meantime, rotational movement of jib 15 in the clockwise direction may be restrained by means of other mechanisms provided on jib connection shaft 21 and jib base end engagement portion 31 on the right side.

(Jib Projection Operation)

In the following, a jib projection operation be described.

(1) As illustrated in FIG. 1, in a state where jib 15 is in a stowed position, jib 15 is stowed along a side of boom 14.

(2) Firstly, boom 14 is slightly extended. Subsequently, jib 15 is moved to the lower holding position in which jib 15 is placed along the bottom of boom 14. Jib 15 is supported by first jib supporting member 16 and second jib supporting member 17. First jib supporting member 16 is provided with hydraulic cylinder 16*a*. Jib 15 can be turned to the lower holding position by extending hydraulic cylinder 16*a*. Boom 14 is then fully retracted. Accordingly, the state as illustrated in FIGS. 2 and 3 is achieved. In this operation, jib connection shafts 21, 22 are fitted into jib base end engagement portions 31, 32, as illustrated in FIG. 4.

(3) Pins 33, 34 are then inserted into insertion holes 31*h*, 32*h*. Jib base end engagement portions 31, 32 are thus connected to jib connection shafts 21, 22. Tension rod 15*b* provided on jib 15 is also connected.

At this stage, jib 15 is in the offset placement in which jib base end 15*a* is located at boom leading end 14*a*, and the leading end of jib 15 is located laterally from boom 14. As described above, gap d1 is formed between pin 34 and jib connection shaft 22. Accordingly, even when boom 14 naturally extends and is not fully retracted by the aforementioned operation of fully retracting the boom, pin 34 can be inserted into insertion holes 32*h* without interfering with jib connection shaft 22. That is, jib base end engagement portion 32 can be connected to jib connection shaft 22.

Figure 8:
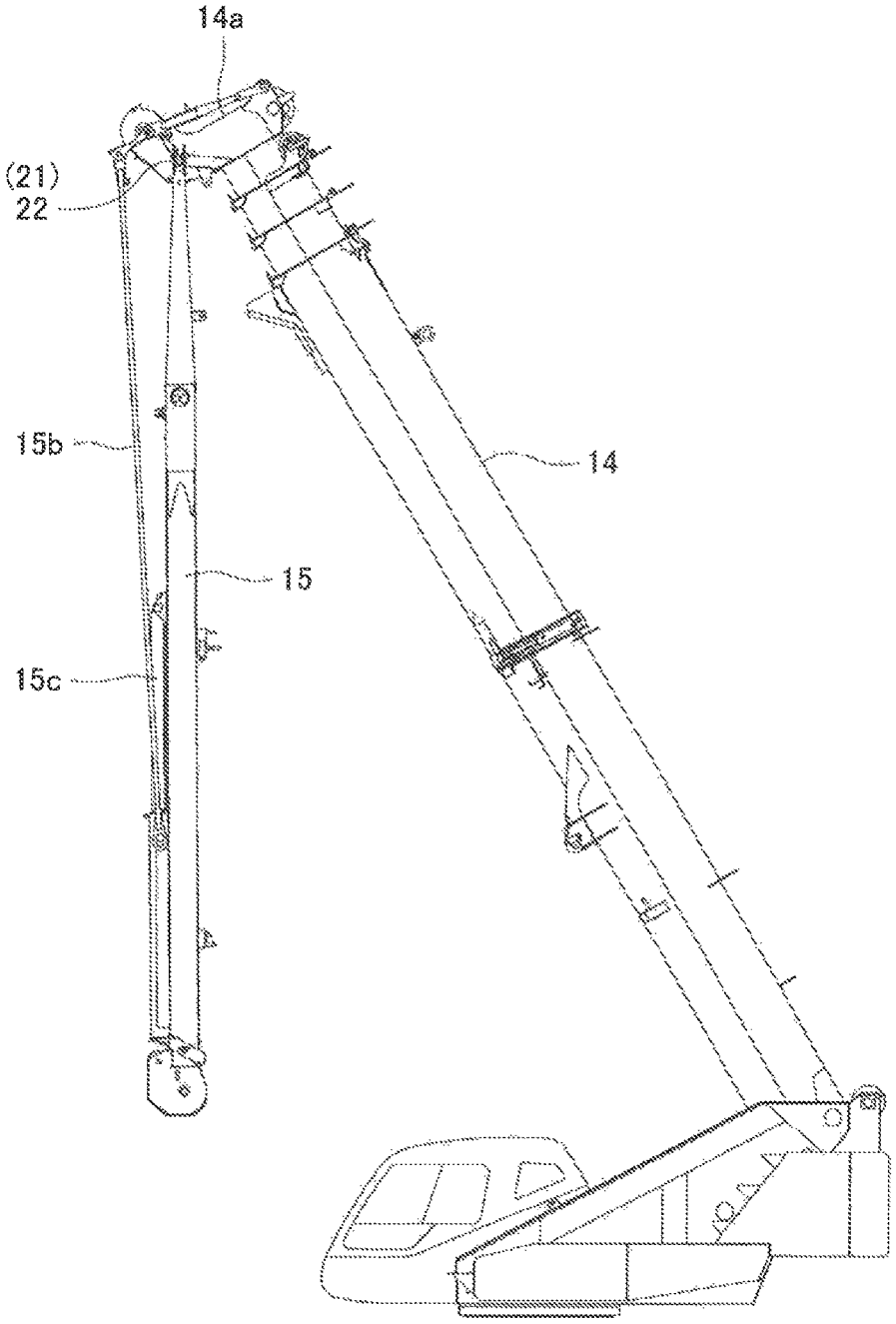
FIG. 8 is a side view illustrating a state where jib 15 is suspended from boom leading end 14*a;*

(4) Boom 14 is then elevated. Subsequently, when boom 14 is slightly extended, first jib supporting member 16 and second jib supporting member 17 are disconnected. Then, as illustrated in FIG. 8, jib 15 rotates about jib connection shafts 21, 22 to become suspended from boom leading end 14*a*.

Figure 9:
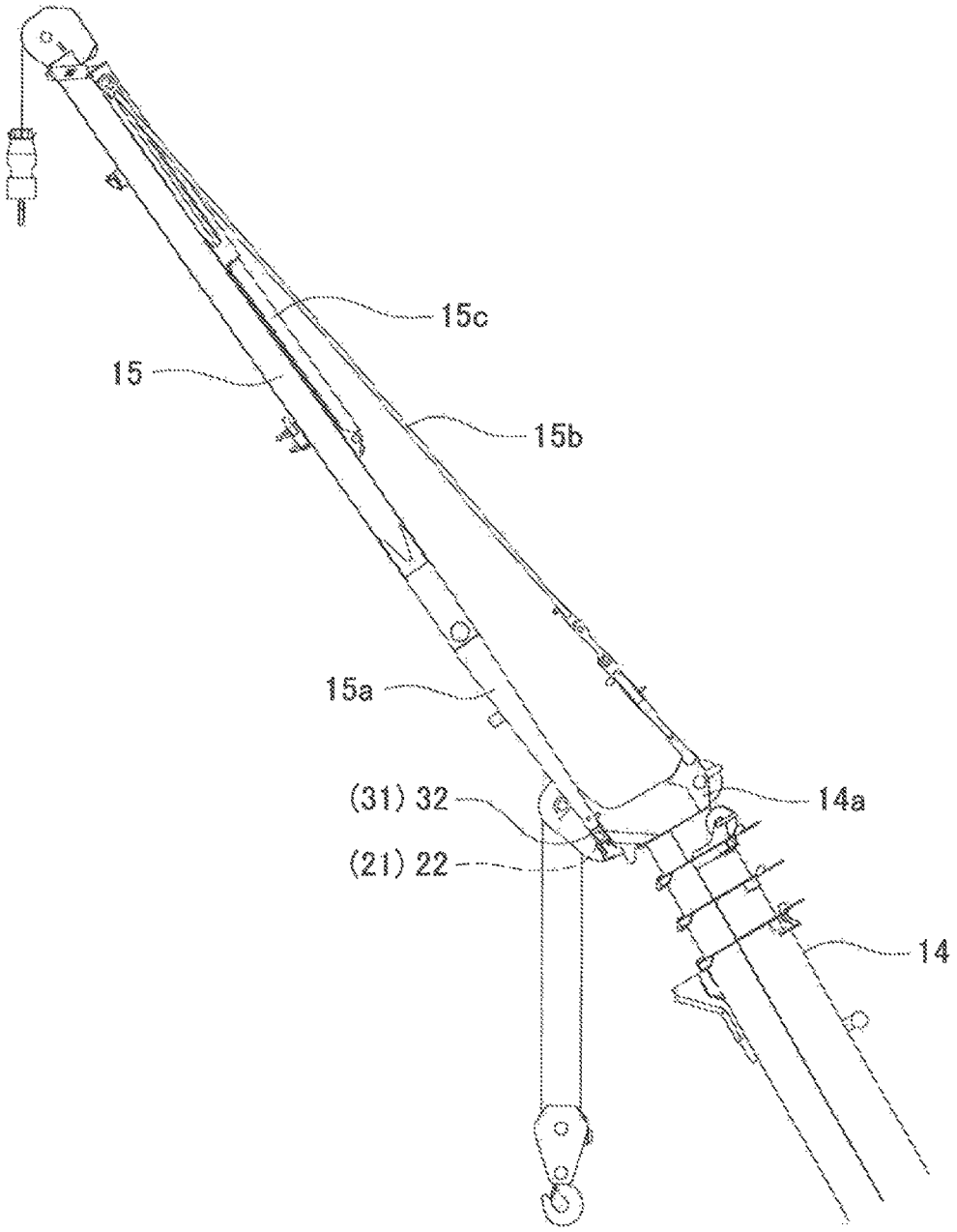
FIG. 9 is a side view illustrating a state where jib 15 is projected.

(5) Tilt cylinder 15*c* is mounted on jib 15. A rod of tilt cylinder 15*c* is connected to tension rod 15*b*. When tilt cylinder 15*c* is extended, tension can be generated on tension rod 15*b*, and jib 15 can be projected forward from jib connection shafts 21, 22. FIG. 9 illustrates a state where tilt cylinder 15*c* is fully extended, in which jib 15 is in substantially straight alignment with boom 14.

When jib 15 is projected, bottom portions 31*b*, 32*b* of jib base end engagement portions 31, 32 are brought into contact with jib connection shafts 21, 22. Accordingly, force acting on jib 15 is transmitted from bottom portions 31*b*, 32*b* of jib base end engagement portions 31, 32 to jib connection shafts 21, 22.

As illustrated in FIG. 7, in a state where jib 15 is projected, gap d2 between pin 34 inserted into insertion holes 32*h* and jib connection shaft 22 becomes narrower than in the case of the offset placement (d1). Jib connection shaft 22 is brought into a state where jib connection shaft 22 is held between bottom portion 32*b* of jib base end engagement portion 32 and pin 34 and is supported from the front and rear. Therefore, jib 15 can be restrained from swinging sideways.

(Jib Stowage Operation)

A jib stowage operation is carried out in a procedure reverse to the jib projection operation. In the jib stowage operation, pins 33, 34 are extracted from insertion holes 31*h*, 32*h* in a state where jib 15 is in the lower holding position and in the offset placement. Also in this case, because there is gap d1 formed between pin 34 and jib connection shaft 22, no frictional force acts between pin 34 and jib connection shaft 22, and pin 34 can be easily extracted.

REFERENCE SIGNS LIST

14 Boom
14*a* Boom leading end
15 Jib
15*a* Jib base end
21, 22 Jib connection shaft
31, 32 Jib base end engagement portion
32*c* Extension plate
31*h*, 32*h* Insertion hole
33, 34 Pin

The invention claimed is:

1. A jib connection structure being a connection structure between a leading end of a boom and a base end of a jib, the jib connection structure comprising:

a jib connection shaft horizontally projecting in both lateral directions of the leading end of the boom; and jib base end engagement portions provided at respective ends of a bifurcated base end of the jib, wherein the jib base end engagement portions are U-shaped into which the jib connection shaft is allowed to be fitted, and include insertion holes for insertion of pins, the pins being intended for preventing slipping off of the jib connection shaft, the insertion holes in one of the jib base end engagement portions is placed, when a leading end of the jib is positioned with an offset to one lateral side with respect to the boom, outwardly from a U-shaped bottom portion on the one lateral side such that a gap is formed between one of the pins inserted into the insertion holes and the jib connection shaft fitted into the jib base end engagement portions, and the insertion holes in one of the jib base end engagement portions are configured to be displaced such that the gap becomes narrower when the jib is rotated in an offset reduction direction.

2. The jib connection structure according to claim 1, wherein:

a distance between an end part of the insertion holes at a jib leading end side, and the bottom portion in a direction along a central axis of the jib, is the same as an outer diameter of the jib connection shaft.

3. The jib connection structure according to claim 1, wherein:

the jib base end engagement portions comprises an extension plate extending outwardly from the U-shaped bottom portion on the one lateral side, and the insertion holes in one of the jib base end engagement portions are provided to the extension plate.

* * * * *